US006994165B2

(12) United States Patent
Roane et al.

(10) Patent No.: US 6,994,165 B2
(45) **Date of Patent: *Feb. 7, 2006**

(54) MULTILATERAL OPEN HOLE GRAVEL PACK COMPLETION METHODS

(75) Inventors: Thomas O. Roane, Katy, TX (US); Travis W. Cavender, Angleton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 311 days.

This patent is subject to a terminal disclaimer.

(21) Appl. No.: 10/191,086

(22) Filed: Jul. 9, 2002

(65) Prior Publication Data

US 2003/0085037 A1 May 8, 2003

Related U.S. Application Data

(63) Continuation-in-part of application No. 09/923,211, filed on Aug. 6, 2001.

(30) Foreign Application Priority Data

Nov. 8, 2001 (WO) ..... PCT/US01/46880

(51) Int. Cl.
*E21B 7/04* (2006.01)

(52) U.S. Cl. ..... 166/278; 166/285; 166/313

(58) Field of Classification Search ..... 166/278, 166/285, 313, 51, 50
See application file for complete search history.

(56) References Cited

U.S. PATENT DOCUMENTS 2,297,308 A * 9/1942 Layne ..... 166/51
2,804,926 A * 9/1957 Zublin ..... 166/50
3,277,962 A * 10/1966 Flickinger et al. ..... 166/278
3,489,216 A 1/1970 Armstrong et al.
3,891,034 A 6/1975 Owen et al.
4,491,178 A 1/1985 Terrell et al.
4,808,029 A 2/1989 Grupping
4,878,539 A 11/1989 Anders
5,033,549 A 7/1991 Champeaux et al.
5,035,285 A 7/1991 Dickinson et al.
5,419,655 A 5/1995 Phillips et al.
5,526,880 A 6/1996 Jordan, Jr. et al.
5,667,023 A 9/1997 Harrell et al.
5,746,274 A 5/1998 Voll et al.
6,070,671 A 6/2000 Cumming et al.
6,125,937 A * 10/2000 Longbottom et al. ..... 166/313
6,176,307 B1 1/2001 Danos et al.
6,311,776 B1 11/2001 Pringle et al.
6,397,946 B1 6/2002 Vail, III
6,457,525 B1 10/2002 Scott
6,675,891 B2 * 1/2004 Hailey et al. ..... 166/51
2003/0024700 A1 * 2/2003 Cavender ..... 166/278

FOREIGN PATENT DOCUMENTS

EP 0 462 567 A2 12/1991

OTHER PUBLICATIONS

International Search Report Application No.: PCT/US01/46880.

* cited by examiner

*Primary Examiner*—David Bagnell
*Assistant Examiner*—Matthew J. Smith
(74) *Attorney, Agent, or Firm*—Marlin R. Smith; J. Richard Konneker

(57) ABSTRACT

A method of gravel packing a branch wellbore extending outwardly from a parent wellbore enables formation of a sealed wellbore junction. In a described embodiment, a gravel packing assembly is positioned in a well, so that an upper packer is in the parent wellbore and a well screen and slurry discharge device are positioned in the branch wellbore. After depositing gravel in the branch wellbore, cement is flowed into the branch wellbore above the gravel.

30 Claims, 3 Drawing Sheets

MULTILATERAL OPEN HOLE GRAVEL PACK COMPLETION METHODS

CROSS-REFERENCE TO RELATED APPLICATION

This application claims the benefit of the filing date under 35 USC §119 of prior international application no. PCT/US01/46880, filed Nov. 8, 2001, the disclosure of which is incorporated hereby by this reference. Further, this application is a continuation-in-part of copending U.S. application Ser. No. 09/923,211, filed on Aug. 6, 2001 and entitled "GAS STORAGE AND PRODUCTION SYSTEM", the disclosure of which is incorporated herein in its entirety by this reference.

BACKGROUND

The present invention relates generally to operations performed in conjunction with subterranean wells and, in an embodiment described herein, more particularly provides a method of gravel packing a multilateral well.

Wells which have intersecting wellbores ("multilateral wells") generally require the wellbore intersections to be sealed. Many proposals have been made for accomplishing this difficult task of sealing wellbore intersections. Some of these have been quite successful and enjoy widespread acceptance in the industry.

However, special problems are encountered when a branch wellbore and a parent wellbore intersect at or relatively near a horizontal inclination and a gravel packing operation is to be performed in the branch wellbore. In the past, this was accomplished by setting a gravel pack packer in the parent wellbore with a well screen positioned in the branch wellbore. A gravel slurry was pumped outwardly through a crossover or other discharge device in the parent wellbore below the packer, and flowed into the branch wellbore.

Unfortunately, this procedure typically results in gravel being deposited on the low sides of the parent and branch wellbores at the intersection. This gravel at the intersection is hard to remove, and it interferes with achieving a seal between the parent and branch wellbores. Of course, this situation is most troublesome when the branch wellbore is completed open hole and, thus, there is no liner available in the branch wellbore to seal against at the wellbore intersection.

Therefore, it may be seen that it would be desirable to provide improved methods of gravel packing a branch wellbore.

SUMMARY

In carrying out the principles of the present invention, in accordance with an embodiment thereof, a method is provided which solves the above problem in the art. The method aids in the formation of a sealed wellbore junction and is particularly useful when a branch wellbore is to be completed open hole and gravel packed.

In one aspect of the invention, a method of gravel packing a branch wellbore extending outwardly from a parent wellbore is provided. The method includes the step of conveying a gravel packing assembly into the parent wellbore, the gravel packing assembly including a packer, a well screen, a tubular string interconnected between the packer and the well screen, and a discharge device for discharging a gravel slurry from the tubular string. The well screen and discharge device are positioned in the branch wellbore and the packer is set in the parent wellbore. The gravel slurry is flowed out of the discharge device and into the branch wellbore about the well screen.

In another aspect of the invention, cement is flowed into the branch wellbore, so that the cement extends in the branch wellbore at least into a window at the intersection between the branch and parent wellbores. The cement seals the wellbore intersection.

In yet another aspect of the invention, after the cementing process, a portion of the tubular string with cement thereabout extends from the branch wellbore into the parent wellbore. The portion of the tubular string extending into the parent wellbore is then cut off, along with the cement extending into the parent wellbore.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
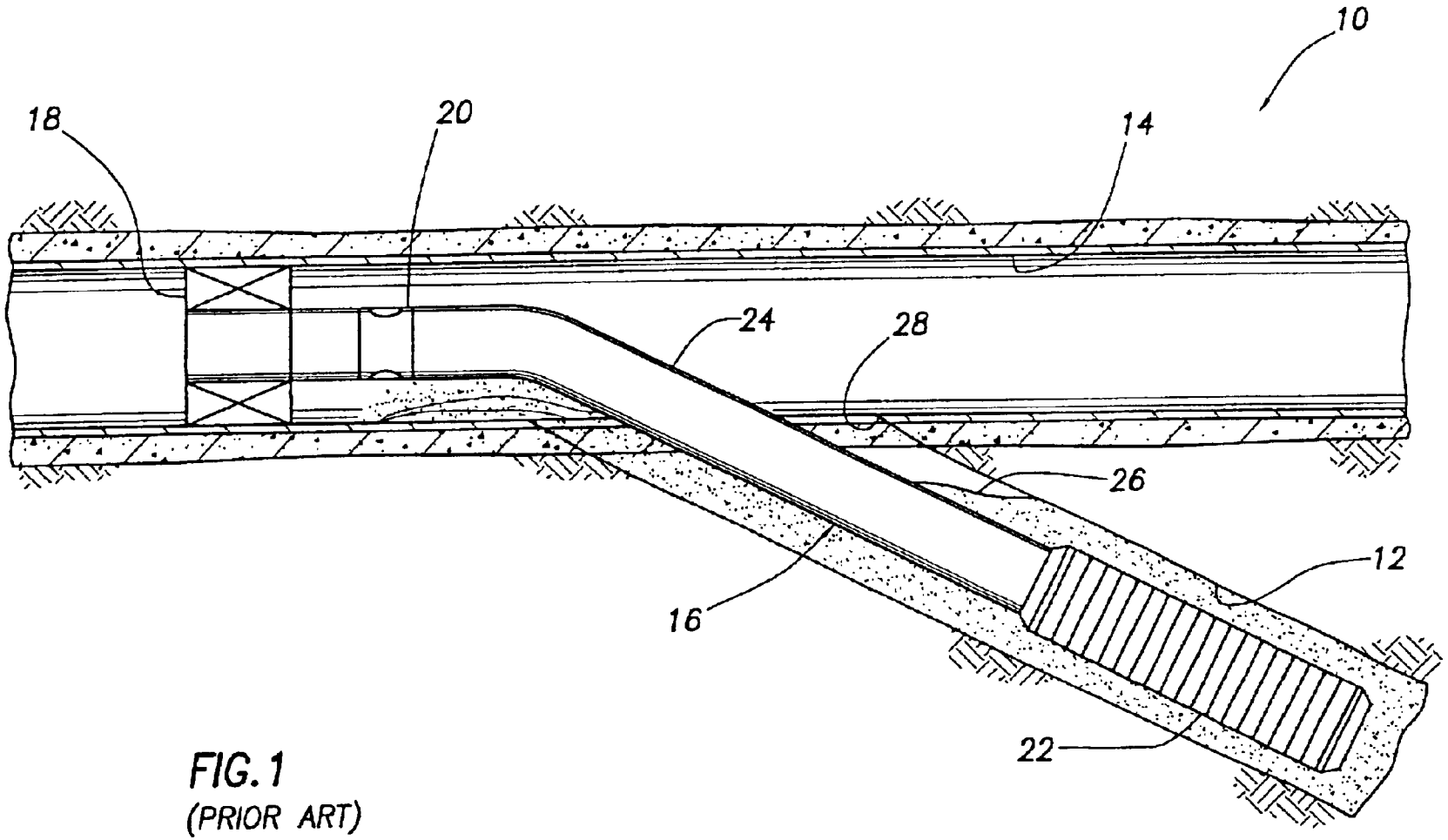
FIG. 1 (PRIOR ART)
FIG. 1 is a schematic partially cross-sectional view of a prior art method of gravel packing a multilateral well.

Illustrated in FIG. 1 is a prior art method 10 of gravel packing in a branch wellbore 12 which intersects a parent wellbore 14. A gravel packing assembly 16 is positioned in the well at the intersection between the wellbores 12, 14. The assembly 16 includes a gravel packing packer 18, a gravel slurry discharge device 20, a well screen 22 and a tubular string 24 interconnected between the discharge device 20 and the screen 22.

The discharge device 20 is typically of the type known to those skilled in the art as a crossover. A gravel slurry pumped through the packer 18 using another tubing string (not shown) is directed laterally outward into the parent wellbore 14 through ports in the device 20. A fluid portion of the slurry is returned to the parent wellbore 14 above the packer 18 via longitudinal passages (not shown) in the device 20. The ports in the device 20 may be closed after the gravel packing procedure is completed.

The gravel slurry is pumped into the parent wellbore 14 prior to flowing the slurry into the branch wellbore 12. The slurry does not flow through the tubular string 24 into the branch wellbore 12. Gravel 26 from the slurry accumulates about the screen 22 in the branch wellbore 12. The fluid portion of the slurry passes inwardly through the screen 22 and flows through the inside of the tubing string 24, crossover 20 and packer 18 back into the parent wellbore 14 above the packer.

As used herein, the term "gravel" broadly indicates any type of particulate material which is used in a well about a screen, for example, to prevent production of formation fines or sand. Gravel may be relatively large grain sand, ceramic particles, etc.

Since the gravel slurry is first pumped into the parent wellbore 14 before flowing into the branch wellbore 12, some of the gravel 26 tends to accumulate in the parent wellbore. This is particularly troublesome when the parent and/or branch wellbores 12, 14 are at or near a horizontal inclination as depicted in FIG. 1. This gravel accumulation may cause problems in other situations, as well.

Note that, in the method 10, the gravel 26 has accumulated in and around a window 28 formed at the intersection of the parent and branch wellbores 12, 14. To achieve a seal between the wellbores 12, 14, for example, to accomplish a wellbore junction known to those skilled in the art as a "Level 4" junction, the periphery of the window 28 will eventually need to be sealed. The presence of the gravel 26 in the window 28 hinders the ability to achieve such a seal, and thus it would be desirable to prevent such accumulation of gravel.

Figure 2:
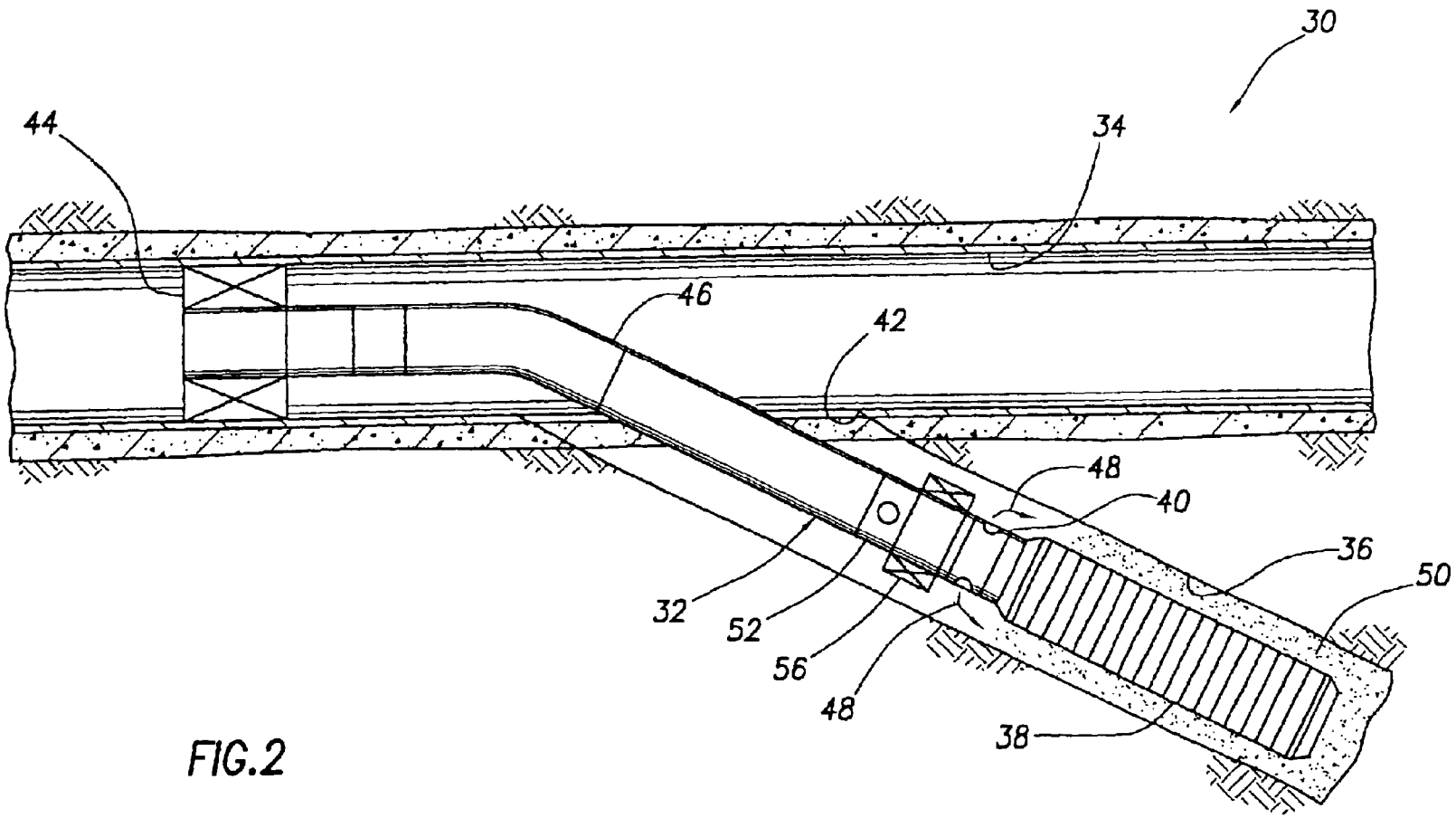
FIG. 2 is a schematic partially cross-sectional view of a method of gravel packing a multilateral well, the method embodying principles of the present invention.

Representatively illustrated in FIG. 2 is a method 30 which embodies principles of the present invention. In the following description of the method 30 and other apparatus and methods described herein, directional terms, such as "above", "below", "upper", "lower", etc., are used only for convenience in referring to the accompanying drawings. Additionally, it is to be understood that the embodiment of the present invention described herein may be utilized in various orientations, such as inclined, inverted, horizontal, vertical, etc., and in various configurations, without departing from the principles of the present invention.

In the method 30, a gravel packing assembly 32 is conveyed into a well and positioned at an intersection between a parent wellbore 34 and a branch wellbore 36. A lower portion of the assembly 32, which includes a well screen 38 and a discharge device 40 (such as a crossover), is displaced through a window 42 from the parent wellbore 34 into the branch wellbore 36. An upper portion of the assembly 32, which includes a gravel packing packer 44, remains in the parent wellbore 34. A tubular string 46, which may be made up of multiple segments, is interconnected between the upper and lower portions of the assembly 32.

The packer 44 is set in a cased portion of the parent wellbore 34. A gravel slurry (indicated by arrows 48) is pumped through the packer 44 and tubular string 46 to the device 40, where it is discharged outwardly into the branch wellbore 36. A gravel portion 50 of the slurry 48 accumulates about the screen 38 while a fluid portion of the slurry flows inwardly through the screen and upwardly through the device 40.

The fluid portion of the slurry 48 flows through the tubular string 46 to the packer 44 and into the parent wellbore 34 above the packer. Note that the tubular string 46 both delivers the gravel slurry 48 into the branch wellbore 36 and returns the fluid portion of the slurry back to the parent wellbore 34. Thus, the tubular string 46 has multiple longitudinal passages therein, which may be provided in any manner, such as by using concentric or coaxial tubular members, providing adjacent flow passages, etc.

Since the gravel slurry 48 is flowed into the branch wellbore 36 without first being flowed into the parent wellbore 34 external to the assembly 32, the gravel 50 does not accumulate in the parent wellbore and does not accumulate in or about the window 42. This facilitates the later sealing between the wellbores 34, 36, as will be described further below. In particular, the lack of gravel accumulation at the intersection between the wellbores 34, 36 is especially helpful when the branch wellbore 36 is completed open hole as depicted in FIG. 2. Of course, the branch wellbore 36 could be cased or could have a liner cemented therein, in keeping with the principles of the invention.

Figure 3:
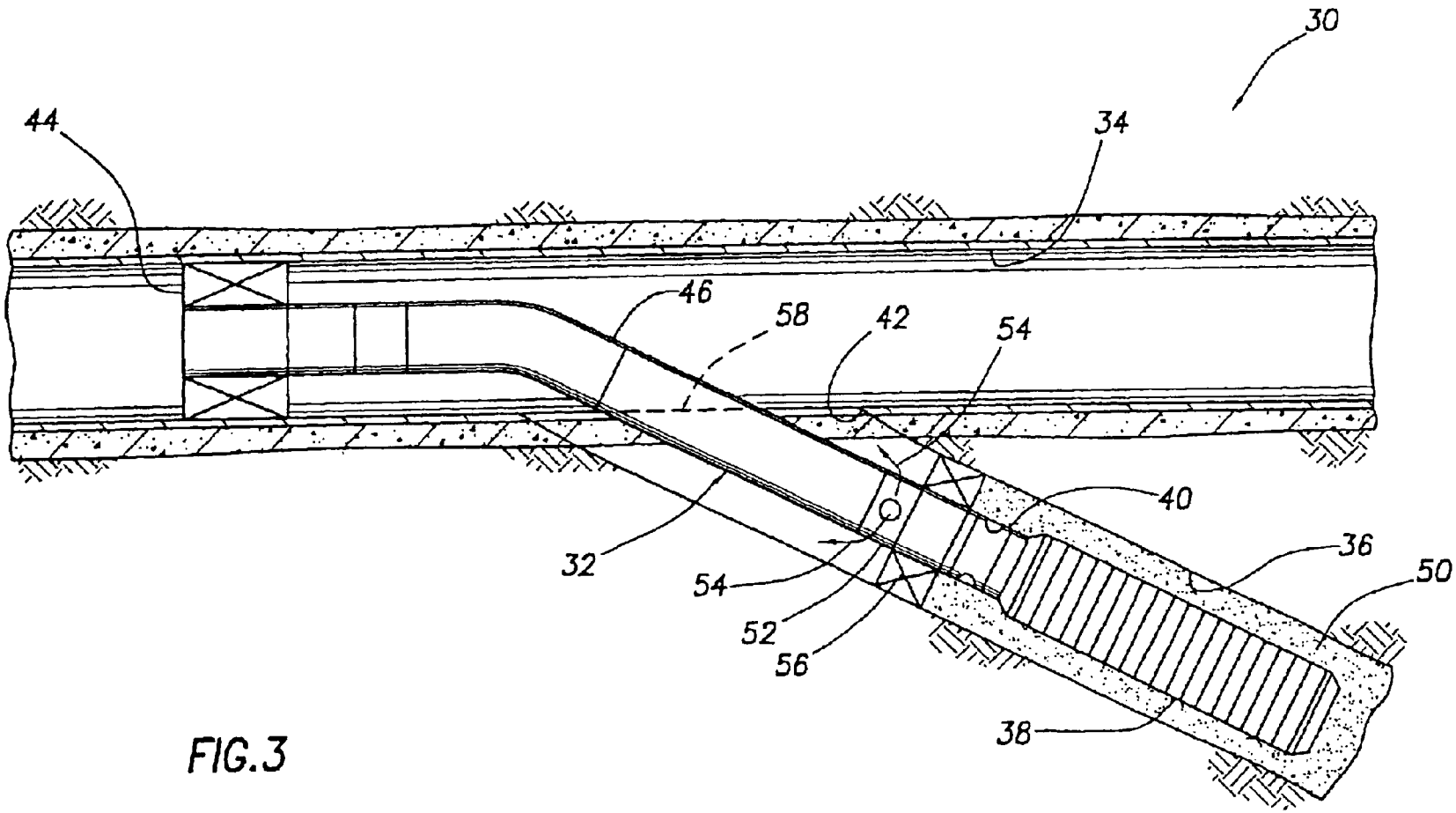
FIG. 3 is a schematic cross-sectional view of the method of FIG. 2, wherein additional steps have been performed.

Referring additionally now to FIG. 3, the method 30 is illustrated after the gravel slurry 48 pumping operation has been completed and the intersection of the wellbores 34, 36 is to be sealed. For this purpose, a ported cementing sub or cementing collar 52 is included in the assembly 32 and is positioned in the branch wellbore 36. Ports in the cementing sub 52 are closed during the gravel slurry 48 pumping operation, but are opened afterward.

Cement (indicated by arrows 54) is pumped outwardly through the open ports of the cementing sub 52 and into the branch wellbore 36 about the assembly 32. As used herein, the term "cement" broadly indicates any hardenable mixture used, for example, to secure or seal equipment in a wellbore. Cement may be an epoxy or other polymer composition, a cementitious material, etc.

The cement 54 flows into the branch wellbore 36 between the window 42 and the gravel 50. A packer 56, such as an inflatable packer, may be included in the assembly 32 to separate the cement 54 from the gravel 50. The packer 56, if included, would be set in the branch wellbore 36 prior to pumping the cement 54.

Note that, if the packer 56 is used, then the packer 44 in the parent wellbore 34 is not necessary. Instead, the packer 56 could be set in the branch wellbore 36 prior to pumping the gravel slurry 48 into the branch wellbore. In that case, the packer 44 could be replaced by, for example, a hydraulic release.

A lower portion of the tubular string 46 is cemented in the branch wellbore 36. The cement 54 preferably flows about the lower portion of the tubular string 46, through the window 42 and into the parent wellbore 34. The objective is to use the cement 54 to seal about the periphery of the window 42, between the window and the tubular string 46, thereby sealing the intersection between the wellbores 34, 36.

To permit access to the parent wellbore 34 below the window 42, the packer 44 and the upper portion of the tubular string 46 are removed after the cement 54 has been allowed to harden. The packer 44 may be retrieved separately from the upper portion of the tubular string 46, for example, by unsetting the packer and disconnecting it from the tubular string 46.

To remove the upper portion of the tubular string 46, a cutting device, such as a mill or overshot (not shown) is used to cut through the tubular string where it extends into the parent wellbore 34 from the branch wellbore 36. That is, the tubular string 46 is cut as indicated by the dashed line 58 in FIG. 3. The portion of the cement 54 which extends through the window 42 into the parent wellbore 34 would also be removed in the same operation.

The result is that a sealed junction between the wellbores 34, 36 is accomplished with the branch wellbore gravel packed about the screen 38.

Of course, a person skilled in the art would, upon a careful consideration of the above description of a representative embodiment of the invention, readily appreciate that many modifications, additions, substitutions, deletions, and other changes may be made to the specific embodiment, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A method of gravel packing a branch wellbore extending outwardly from a parent wellbore, the method comprising the steps of:

conveying a gravel packing assembly into the parent wellbore, the gravel packing assembly including a first packer, a well screen, a tubular string interconnected between the packer and the well screen, and a discharge device for discharging a gravel slurry from the tubular string;

positioning the well screen and discharge device in the branch wellbore;

setting the first packer in the parent wellbore; and flowing the gravel slurry out of the discharge device and into the branch wellbore about the well screen.

2. The method according to claim 1, wherein the branch wellbore extends outwardly from a window formed in the parent wellbore, and wherein the flowing step further comprises preventing the gravel slurry from flowing into the window.

3. The method according to claim 2, wherein in the flowing step, the tubular string extends through the window, the first packer is set in the parent wellbore, and the discharge device is positioned in the branch wellbore.

4. The method according to claim 1, wherein the positioning step further comprises positioning the well screen in an open hole portion of the branch wellbore.

5. The method according to claim 4, wherein the setting step further comprises setting the first packer in a cased portion of the parent wellbore.

6. The method according to claim 1, wherein the positioning step further comprises positioning a ported cementing sub in the branch wellbore.

7. The method according to claim 6, wherein the gravel slurry flowing step further comprises flowing the gravel slurry through the cementing sub.

8. The method according to claim 6, further comprising the step of flowing cement out of the cementing sub and into the branch wellbore about the tubular string.

9. The method according to claim 8, wherein the cement flowing step further comprises flowing the cement into the branch wellbore between gravel deposited in the branch wellbore in the gravel slurry flowing step and an intersection between the branch and parent wellbores.

10. The method according to claim 9, wherein the cement flowing step further comprises flowing the cement into the parent wellbore from the branch wellbore.

11. The method according to claim 10, further comprising the step of cutting off the cement and tubular string extending into the parent wellbore from the branch wellbore.

12. The method according to claim 1, wherein the gravel slurry flowing step further comprises flowing the gravel slurry through the tubular string into the branch wellbore, and returning a fluid portion of the slurry through the tubular string to the parent wellbore.

13. A method of gravel packing a branch wellbore extending outwardly from a window in a parent wellbore, the method comprising the steps of:

depositing gravel about a well screen in the branch wellbore; and then flowing cement into the branch wellbore, the cement extending in the branch wellbore at least into the window.

14. The method according to claim 13, wherein the flowing step further comprises flowing the cement through the window.

15. The method according to claim 13, wherein the flowing step further comprises flowing the cement into the parent wellbore.

16. The method according to claim 15, wherein the gravel depositing step further comprises flowing a gravel slurry through a tubular string extending from the parent wellbore into the branch wellbore, and further comprising the step of cutting off the cement and the tubular string at the window.

17. The method according to claim 16, wherein the gravel slurry flowing step further comprises returning a fluid portion of the slurry through the tubular string to the parent wellbore.

18. The method according to claim 13, wherein the cement flowing step further comprises flowing the cement through a ported cementing sub positioned in the branch wellbore.

19. The method according to claim 18, further comprising the step of setting a packer between the cementing sub and the gravel deposited in the branch wellbore prior to the cement flowing step.

20. The method according to claim 18, wherein the gravel depositing step further comprises flowing a gravel slurry through the cementing sub.

21. A method of gravel packing a branch wellbore extending outwardly from a parent wellbore, the method comprising the steps of:

positioning a tubular string, a well screen and a gravel slurry discharge device in the branch wellbore;

discharging a gravel slurry from the tubular string via the discharge device, gravel from the slurry being deposited into the branch wellbore about the well screen;

cementing the tubular string in the branch wellbore, so that a portion of the tubular string with cement thereabout extends from the branch wellbore into the parent wellbore; and cutting off the portion of the tubular string extending into the parent wellbore.

22. The method according to claim 21, further comprising the step of setting a packer in the parent wellbore, the packer being connected to the tubular string, prior to the gravel slurry discharging step.

23. The method according to claim 22, wherein in the gravel slurry discharging step, the gravel slurry is flowed through the packer while the packer is set in the parent wellbore.

24. The method according to claim 23, wherein the cementing step further comprises flowing the cement through the packer and outward into the branch wellbore through a ported cementing sub positioned in the branch wellbore.

25. The method according to claim 24, wherein the gravel slurry discharging step further comprises flowing the gravel slurry through the cementing sub.

26. The method according to claim 21, wherein the gravel slurry discharging step further comprises returning a fluid portion of the slurry through the tubular string to the parent wellbore.

27. The method according to claim 21, further comprising the step of setting a packer in the branch wellbore, the packer being connected to the tubular string, prior to the gravel slurry discharging step.

28. The method according to claim 27, wherein in the gravel slurry discharging step, the gravel slurry is flowed through the packer while the packer is set in the branch wellbore.

29. The method according to claim 28, wherein the cementing step further comprises flowing the cement through the packer and outward into the branch wellbore through a ported cementing sub positioned in the branch wellbore.

30. The method according to claim 29, wherein the gravel slurry discharging step further comprises flowing the gravel slurry through the cementing sub.

* * * * *